US010569995B2

(12) United States Patent
Roodenburg et al.

(10) Patent No.: US 10,569,995 B2
(45) Date of Patent: Feb. 25, 2020

(54) OFFSHORE SYSTEM WITH MOVABLE CANTILEVER

(71) Applicant: ITREC B.V., Schiedam (NL)

(72) Inventors: Joop Roodenburg, Schiedam (NL); Diederick Bernardus Wijning, Schiedam (NL)

(73) Assignee: ITREC B.V., Schiedam (NL)

( * ) Notice: Subject to any disclaimer, the term of this patent is extended or adjusted under 35 U.S.C. 154(b) by 4 days.

(21) Appl. No.: 15/755,005

(22) PCT Filed: Aug. 24, 2016

(86) PCT No.: PCT/NL2016/050588

§ 371 (c)(1),
(2) Date: Feb. 23, 2018

(87) PCT Pub. No.: WO2017/034403

PCT Pub. Date: Mar. 2, 2017

(65) Prior Publication Data

US 2019/0177133 A1 Jun. 13, 2019

(30) Foreign Application Priority Data

Aug. 26, 2015 (NL) ..... 2015351

(51) Int. Cl.
*E02B 17/00* (2006.01)
*E02B 17/02* (2006.01)
(Continued)

(52) U.S. Cl.
CPC ..... *B66C 23/53* (2013.01); *B63B 35/4413* (2013.01); *E02B 17/021* (2013.01);
(Continued)

(58) Field of Classification Search
CPC ..... E02B 17/021; E21B 15/003; E21B 15/00; E21B 15/02; B63B 35/4413
(Continued)

(56) References Cited

U.S. PATENT DOCUMENTS 4,602,894 A * 7/1986 Lorenz ..... E21B 15/003 175/7
6,171,027 B1 * 1/2001 Blankestijin ..... E02B 17/021 405/201
6,729,804 B1 * 5/2004 Roodenburg ..... B63B 35/44 175/5
6,932,553 B1 * 8/2005 Roodenburg ..... E21B 15/003 166/343
(Continued)

FOREIGN PATENT DOCUMENTS

WO WO-2009035448 A1 * 3/2009 ..... E21B 15/003
WO WO-2013133694 A1 * 9/2013 ..... B66C 5/10
(Continued)

OTHER PUBLICATIONS

Dutch Search Report, issued in Priority Application No. 2015351, dated Jun. 3, 2016.
(Continued)

*Primary Examiner* — Frederick L Lagman
(74) *Attorney, Agent, or Firm* — Birch, Stewart, Kolasch & Birch, LLP

(57) ABSTRACT

An offshore system includes a vessel having a deck; a cantilever which is mounted on the deck and which is moveable in a longitudinal direction of the cantilever relative to the deck between a retracted position and an extended position, and which is rotatable relative to the deck about a substantially vertical swivel axis; and actuators to move the cantilever in longitudinal direction and to rotate the cantilever about the swivel axis. The swivel axis is provided by a single sliding and swivel assembly arranged at one end of the cantilever, including a fixed part mounted to the deck and a sliding part mounted to the cantilever. The sliding part is arranged to slide in longitudinal direction of the cantilever relative to the fixed part when the cantilever moves in the
(Continued)

longitudinal direction. The fixed part and/or the combination of fixed part and sliding part are configured to form the swivel axis allowing the cantilever to rotate relative to the deck. A sliding assembly is arranged at the other end of the cantilever supporting the cantilever and allowing the cantilever to slide in longitudinal direction of the cantilever relative to the deck during movement of the cantilever in longitudinal direction, and to slide in a transverse direction perpendicular to the longitudinal direction relative to the deck during rotation of the cantilever relative to the deck.

20 Claims, 5 Drawing Sheets

(51) Int. Cl.

| | |
|---|---|
| ***E21B 15/00*** | (2006.01) |
| ***B63B 35/44*** | (2006.01) |
| ***B66C 23/53*** | (2006.01) |
| ***E02B 17/04*** | (2006.01) |
| *E21B 7/12* | (2006.01) |

(52) U.S. Cl.
CPC ..... *E02B 17/04* (2013.01); *E21B 15/003* (2013.01); *E02B 2017/0056* (2013.01); *E21B 7/12* (2013.01)

(58) Field of Classification Search
USPC ..... 405/201, 202
See application file for complete search history.

(56) References Cited

U.S. PATENT DOCUMENTS

| | | | | |
|---|---|---|---|---|
| 7,083,004 | B2 * | 8/2006 | Roodenburg | E02B 17/021 166/366 |
| 8,439,606 | B2 * | 5/2013 | Foo | E21B 15/003 405/201 |
| 9,284,706 | B2 * | 3/2016 | Roodenburg | B66C 5/10 |
| 2004/0067110 | A1 * | 4/2004 | Bennett, Jr. | E02B 17/021 405/196 |
| 2004/0151549 | A1 * | 8/2004 | Roodenburg | E02B 17/021 405/201 |
| 2008/0044234 | A1 * | 2/2008 | Morrison | E02B 17/0004 405/201 |
| 2008/0298898 | A1 * | 12/2008 | Roodenburg | E02B 17/00 405/196 |
| 2010/0260555 | A1 | 10/2010 | Foo et al. | |
| 2015/0034383 | A1 | 2/2015 | Roodenburg et al. | |

FOREIGN PATENT DOCUMENTS

| | | | | |
|---|---|---|---|---|
| WO | WO-2016200265 | A1 * | 12/2016 | B66C 5/10 |
| WO | WO-2016209720 | A1 * | 12/2016 | E21B 15/003 |

OTHER PUBLICATIONS

International Search Report, issued in PCT/NL2016/050588, dated Nov. 9, 2016.
Written Opinion of the International Searching Authority, issued in PCT/NL2016/050588, dated Nov. 9, 2016.

* cited by examiner

OFFSHORE SYSTEM WITH MOVABLE CANTILEVER

The invention relates to an offshore system comprising a moveable cantilever that is moveable in a longitudinal direction of the cantilever between a retracted position and an extended position, and that is rotatable about a substantially vertical swivel axis.

A general problem when designing offshore systems is that positioning an operational end of the cantilever beyond the deck will result in relatively large bending moments and thus relatively high loads applied to the supporting structure supporting the cantilever from the deck. This requires even more attention in case the cantilever is not only moveable in longitudinal direction, but also rotatable about a substantially vertical swivel axis.

Prior art offshore systems with a moveable and rotatable cantilever are known in the art, but these systems are not considered satisfactory.

It is therefore an object of the invention to provide an improved offshore system.

The object is achieved by providing an offshore system according to claim 1, wherein the offshore system comprises:

- a vessel having a deck;
- a cantilever which is mounted on the deck and which is moveable in a longitudinal direction of the cantilever relative to the deck between a retracted position and an extended position, and which is rotatable relative to the deck about a substantially vertical swivel axis; and
- actuators to move the cantilever in longitudinal direction and to rotate the cantilever about the swivel axis, wherein the swivel axis is provided by a single sliding and swivel assembly arranged at one end of the cantilever, comprising a fixed part mounted to the deck and a sliding part mounted to the cantilever, wherein the sliding part is arranged to slide in longitudinal direction of the cantilever relative to the fixed part when the cantilever moves in the longitudinal direction, wherein the fixed part and/or the combination of fixed part and sliding part are configured to form the swivel axis allowing the cantilever to rotate relative to the deck, and wherein a sliding assembly is arranged at the other end of the cantilever supporting the cantilever and allowing the cantilever to slide in longitudinal direction of the cantilever relative to the deck during movement of the cantilever in longitudinal direction, and to slide in a transverse direction perpendicular to the longitudinal direction relative to the deck during rotation of the cantilever relative to the deck.

An advantage of using a single sliding and swivel assembly with the fixed part mounted to the deck and the sliding part mounted to the cantilever is that the swivel axis is stationary relative to the deck, so that upon moving the cantilever towards the extended position, the bending arm between sliding assembly and swivel axis remains substantially constant thereby allowing to keep the loads applied to the sliding and swivel assembly within limits compared to a prior art solution in which the swivel axis moves along with the cantilever.

In an embodiment, the fixed part of the sliding and swivel assembly comprises a stationary part and a rotatable part with a bearing in between the stationary part and the rotatable part forming the substantially vertical swivel axis. Said bearing may be a slew bearing.

This allows to separate the sliding function and the swivel function in the sliding and swivel assembly giving more design freedom.

In an embodiment, the sliding part of the sliding and swivel assembly comprises one or more rails engaging with sliding shoes arranged on the rotatable part of the fixed part of the sliding and swivel assembly.

In an embodiment, cables and/or hoses provided between the vessel and the cantilever for power and/or fluid transport extend through the sliding and swivel assembly. In this way the effect of the movement and rotation of the cantilever relative to the deck on the cables and/or hoses is minimal.

In an embodiment, the cantilever comprises an operational end which extends beyond the deck in the extended position of the cantilever and an inner end opposite the operational end.

In an embodiment, the sliding and swivel assembly is located at the inner end of the cantilever and the sliding assembly is located at the operational end of the cantilever.

In an embodiment, equipment is positioned at the inner end of the cantilever for providing counterweight to the equipment positioned at the operational end of the cantilever.

In an embodiment, the sliding assembly comprises a cantilever rail arranged on the cantilever and extending in the longitudinal direction, a deck rail arranged on the deck and substantially extending in the transverse direction, a deck slide shoe engaging with the deck rail, and a cantilever slide shoe engaging with the cantilever rail and arranged on top of the deck slide shoe.

In an embodiment, the actuators are arranged on the cantilever slide shoe and/or the deck slide shoe.

In an embodiment, the deck rail has a radius of curvature and corresponding centre point coinciding with the swivel axis. This may have the advantage that an orientation between the cantilever slide shoe and the deck slide shoe can be fixed and thus the cantilever and deck slide shoes can be integrated if desired.

In an embodiment, the actuators comprise a first actuator having a rack and pinion configuration for moving the cantilever in the longitudinal direction relative to the cantilever slide shoe, and wherein the rack is arranged on the cantilever and the pinion including drive thereof is mounted to the cantilever slide shoe.

In an embodiment, the actuators comprise a second actuator having a rack and pinion configuration for moving the deck slide shoe relative to the deck, and wherein the rack is arranged on the deck and the pinion including drive thereof is mounted to the deck slide shoe.

In an embodiment, the vessel comprises an elongated hull with an aft end and a front end, and wherein a longitudinal axis of the cantilever is substantially parallel to a longitudinal axis of the elongated hull so that the cantilever in the extended position extends beyond the aft end of the hull.

In an embodiment, the vessel comprises a jack-up system with legs to lift the hull of the vessel relative to a bottom of a body of water.

In an embodiment, the jack-up system comprises four legs, two at the aft end of the hull and two at the front end of the hull, wherein the cantilever, e.g. in any longitudinal axis position thereof, extends or is arranged between the two legs at the aft end of the hull. For example this vessel is a mono-hull vessel with two legs along the port side of the hull and two legs along the starboard side of the hull, e.g. with the cantilever being extendable over the stern of the hull and with an accommodation and bridge structure at the bow of the vessel.

The operational end of the cantilever may be used to accommodate or be provided with a drilling tower for performing subsea wellbore related activities, e.g. drilling, servicing, plug and abandonment of a subsea wellbore, a crane, a multi-purpose tower for drilling and other activities, or any other equipment.

The cantilever may comprise an elongated main body with two vertical main side walls, a top wall forming a top deck, and a bottom wall.

A bottom wall of the cantilever may be provided with one or more rails, fixed to the cantilever and extending parallel to the longitudinal axis of the cantilever. Said one or more rails fixed on the bottom of the cantilever engage corresponding sliding shoes arranged on a rotatable part of the fixed part of the sliding and swivel assembly. A bearing is arranged to allow for swiveling of the rotatable part about the vertical swivel axis. For example the cantilever has a recess in the bottom thereof, in which said one or more rails are arranged, e.g. an elongated recess along the longitudinal axis of the recess.

Equipment, e.g. drilling related equipment like (mud) store tanks, mud handling equipment, etc., may also be deliberately positioned at the inner end to form counterweight for equipment at the operational end. For example the drilling tower is arranged at the operational end. For example the operational end comprises a moonpool through the cantilever.

The present invention also relates to a method for performing subsea wellbore related activities, e.g. drilling, servicing, and or plug and abandonment of the wellbore, wherein use is made of an offshore system as described herein and wherein the longitudinal and swivel motion of the cantilever is used to align the cantilever, e.g. equipment on the operational end thereof, with the wellbore.

The invention will now be described in a non-limiting way by reference to the accompanying drawings, in which like parts are indicated by like reference symbols, and in which:

FIG. 1 schematically depicts a top view of an offshore system according to an embodiment of the invention;

FIG. 2A, B schematically depict a sliding and swivel assembly of the offshore system of FIG. 1 in more detail;

FIG. 3A, B schematically depict a sliding assembly of the offshore system of FIG. 1 in more detail;

FIG. 4A, B schematically depict a sliding and swivel assembly of an offshore system according to another embodiment of the invention; and FIG. 5 schematically depicts a sliding assembly of an offshore system according to another embodiment of the invention.

FIG. 1 schematically depicts a top view of an offshore system according to an embodiment of the invention, comprising a vessel VE with a deck DE, and a cantilever CA which is mounted on the deck DE.

The vessel in this embodiment is a monohull vessel with an elongated hull HU, but the invention can be applied to any type of vessel, including but not limited to semi-submersibles, jack-up platforms, barges, etc.

The vessel is equipped with a jack-up system to lift the vessel at least partly out of the water. The jack-up system in this embodiment comprises four legs LE arranged in a rectangular configuration and configured to lift the hull of the vessel relative to a bottom of a body of water when the legs are moved downwards relative to the hull.

The depicted vessel is a mono-hull vessel with two legs LE along the port side of the hull and two legs along the starboard side of the hull, with the cantilever being extendable over the stern of the hull and with an accommodation and bridge structure (not shown) raised above the deck at the bow of the vessel.

The rectangular configuration results in two legs LE being arranged at the aft end AE, i.e. the stern, of the vessel, and the other two legs LE being arranged at the front end FE, i.e. the bow, of the vessel. Other configurations of the jack-up system, e.g. depending on the vessel, are also possible. An example is a triangular shaped platform having a leg in each corner of the triangular shaped platform.

The elongated hull HU of the vessel has a longitudinal axis LAH and the cantilever CA has a longitudinal axis LAC substantially parallel to the longitudinal axis LAH of the hull HU.

The cantilever CA is moveable in a longitudinal direction LD of the cantilever CA, which is parallel to the longitudinal axis LAC of the cantilever, relative to the deck between a retracted position (shown in solid lines in FIG. 1) and an extended position (shown in dashed lines in FIG. 1).

Additionally, the cantilever CA is rotatable relative to the deck about a substantially vertical swivel axis SA as indicated by arrow R.

Actuators (not shown) are provided to move the cantilever CA in longitudinal direction LD and to rotate the cantilever CA about the swivel axis SA.

Reference will now also be made to FIGS. 2A and 2B which depict in more detail a sliding and swivel assembly of the offshore system of FIG. 1 providing the swivel axis SA. FIG. 2A depicts a cross sectional view of the sliding and swivel assembly as seen in a direction parallel to the longitudinal direction LD, where FIG. 2B depicts a cross sectional view of the sliding and swivel assembly as seen in a direction parallel to a transverse direction TD (see FIG. 1), which is perpendicular to the longitudinal direction LD.

The sliding and swivel assembly comprises a fixed part mounted to the deck DE and a sliding part mounted to the cantilever CA. In this embodiment, the fixed part is a head H having a circular shape in top view connected to the deck DE by a thinner part TP, and the sliding part has a groove GR extending in longitudinal direction LD in which the head H of the fixed part is received, so that the head H and groove GR are able to apply vertical forces to each other, preferably in both directions, supporting the cantilever and preventing the cantilever from falling into the sea in the extended position.

The groove GR and the head H are able to rotate relative to each other thereby forming the swivel axis SA. Further, due to the groove GR extending in longitudinal direction, the cantilever is allowed to move in the longitudinal direction while the groove and head keep on being engaged with each other.

The sliding and swivel assembly supports the cantilever at one end, in this case an inner end IE of the cantilever, from the deck DE, but the offshore assembly also comprises one or more sliding assemblies supporting the cantilever at an opposite end, in this case an operational end OE of the cantilever. The sliding assembly is shown in more detail in FIGS. 3A and 3B.

An advantage of a sliding and swivel assembly according to the invention is that the swivel axis SA is stationary relative to the deck, so that the distance L between swivel axis SA and the sliding assembly at the operational end OE of the cantilever is always the same independent of the position of the cantilever relative to the deck.

FIG. 3A depicts a side view of a sliding assembly. One of the functions of the sliding assembly is to allow the cantilever to slide in longitudinal direction LD of the cantilever CA relative to the deck DE during movement of the cantilever in longitudinal direction, and to allow the cantilever to slide in the transverse direction TD perpendicular to the longitudinal direction LD relative to the deck DE during rotation of the cantilever.

In the embodiment of FIG. 3A and FIG. 3B, the sliding assembly comprises a cantilever rail CR arranged on the cantilever CA and extending in the longitudinal direction LD, a deck rail DR arranged on the deck DE and substantially extending in the transverse direction TD, a deck slide shoe DSS engaging with the deck rail DR, and a cantilever slide shoe CSS engaging with the cantilever rail CR and arranged on top of the deck slide shoe DSS.

When the deck rail DR is straight and extends parallel to the transverse direction TD as shown in FIG. 1, it is preferred that the cantilever slide shoe CSS and deck slide shoe DSS are able to rotate relative to each other during rotation of the cantilever, as in a rotated orientation, the longitudinal axis of the cantilever may no longer be perpendicular to the deck rail DR.

Figure 4A:
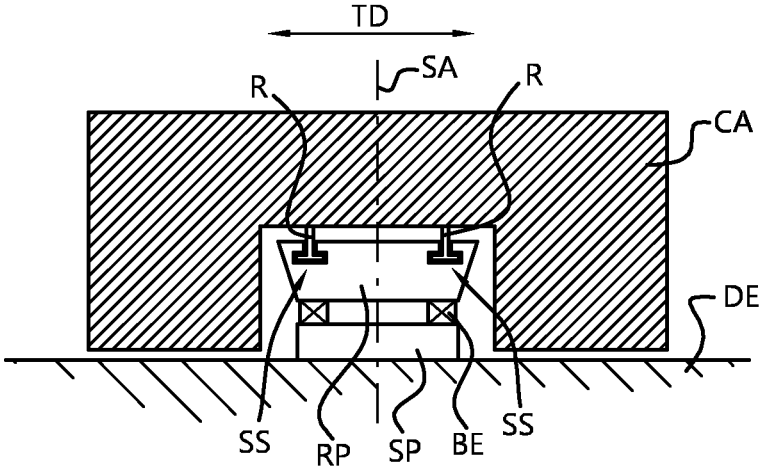
FIG. 4A and FIG. 4B depict a sliding and swivel assembly according to another embodiment of the invention. The sliding and swivel assembly comprises a fixed part connected to a deck DE of a vessel and a sliding part connected to a cantilever CA similar to the embodiment in FIG. 2A and FIG. 2B.
Figure 4B:
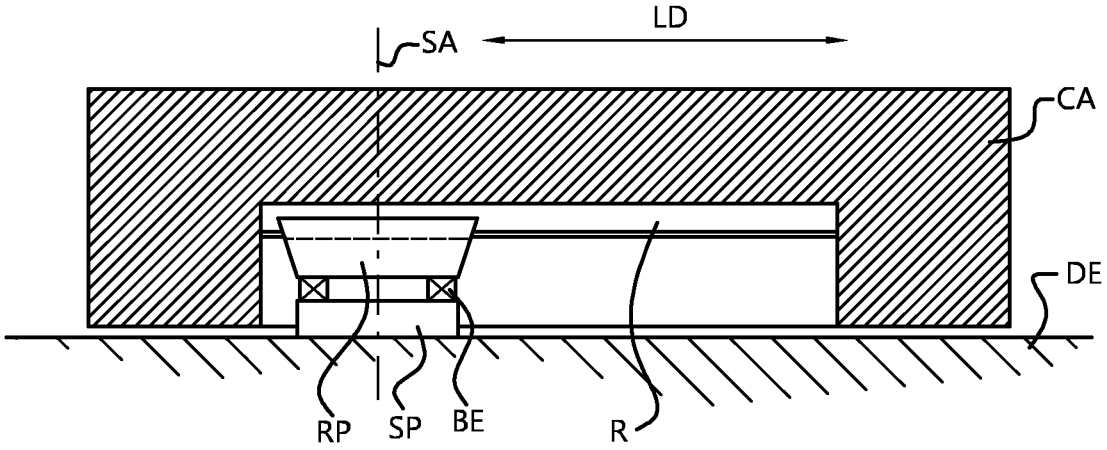

However, the fixed part in FIGS. 4A and 4B comprises a stationary part SP mounted to the deck DE and a rotatable part RP with a bearing BE, i.e. a slew bearing, in between the stationary part SP and the rotatable part RP forming the substantially vertical swivel axis SA.

The sliding part on the cantilever CA comprises one or more rails, in this embodiment two rails R, engaging with corresponding sliding shoes SS arranged on the rotatable part RP of the fixed part of the sliding and swivel assembly. This allows the cantilever to move in the longitudinal direction LD relative to the fixed part of the sliding and swivel assembly, while the bearing BE allows the cantilever to rotate about the swivel axis SA. Hence, the sliding and swivel assembly is able to effectively support the cantilever while at the same time the cantilever is allowed to move and rotate.

In this embodiment, the two rails R are positioned at a distance from each other seen in transverse direction TD that substantially corresponds to the diameter of the bearing BE, so that forces applied by the cantilever to the rotatable part of the fixed part are effectively transferred to the bearing BE and in turn to the deck DE thereby minimizing deformations.

FIGS. 4A and 4B also depict that the cantilever may comprise an elongated main body with two vertical main side walls, a top wall forming a top deck, e.g. on which subsea wellbore drilling equipment, e.g. including a drilling tower is arranged, and a bottom wall.

In this example the cantilever has a recess in the bottom thereof, in which said one or more rails are arranged, e.g. an elongated recess along the longitudinal axis of the recess. These one or more rails fixed on the cantilever in said recess engage the corresponding sliding shoes arranged on a rotatable part of the fixed part of the sliding and swivel assembly.

Figure 1:
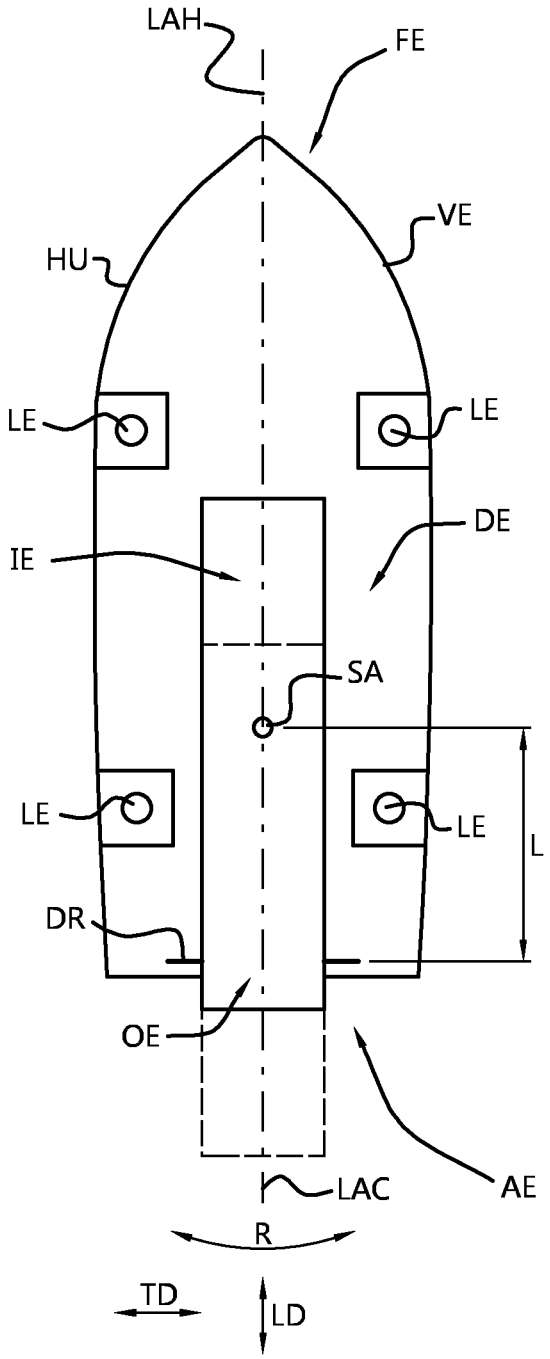
Figure 2A:
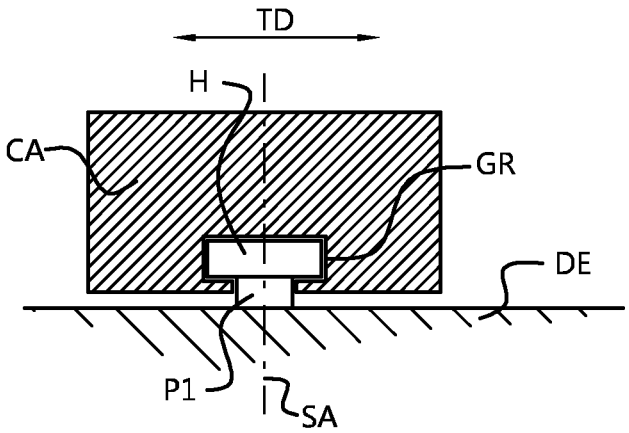
Figure 2B:
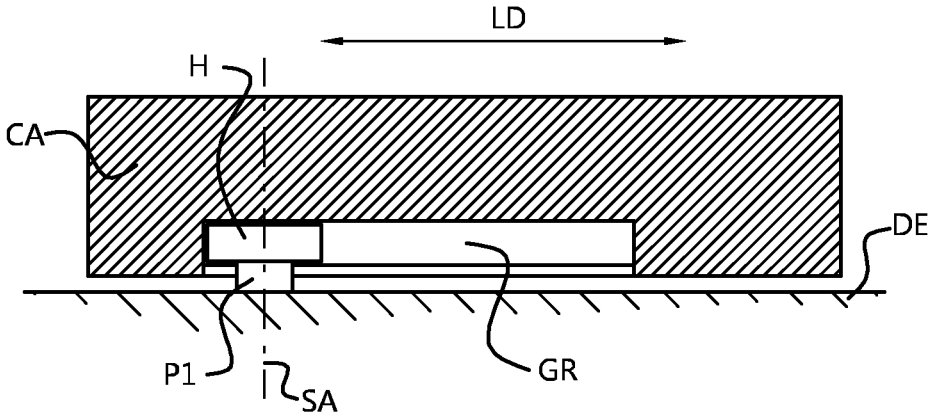
Figure 3A:
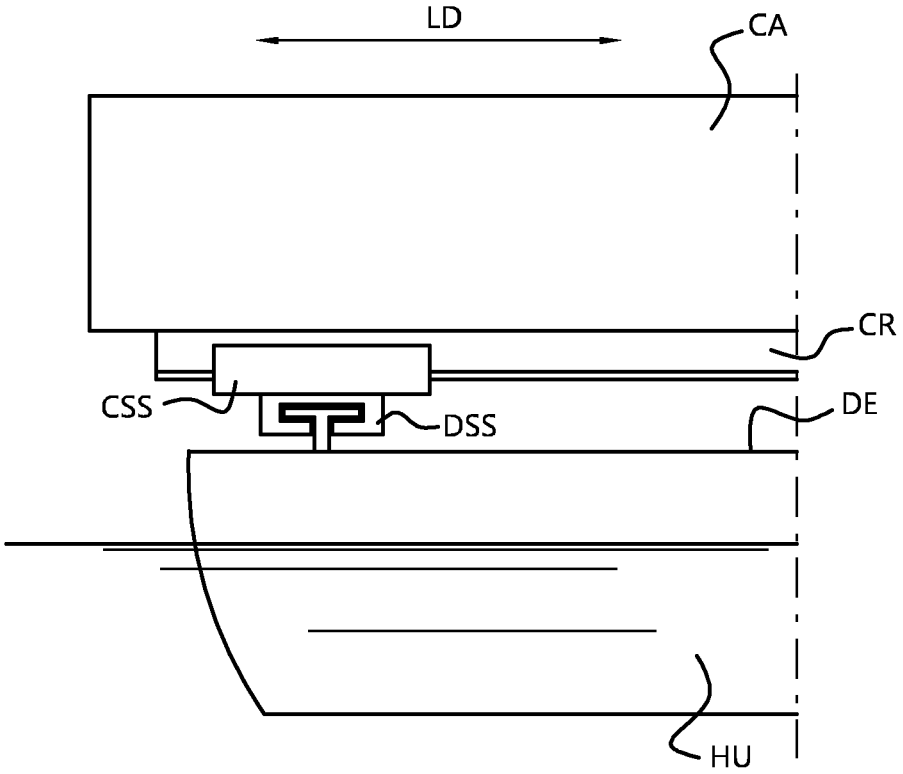
FIG. 3B depicts a top view of the aft end AE of the vessel VE showing the cantilever CA and deck rail DR. In phantom are shown two sliding assemblies supporting the cantilever from the deck rail DR using a deck slide shoe DSS and a cantilever slide shoe CSS.
Figure 3B:
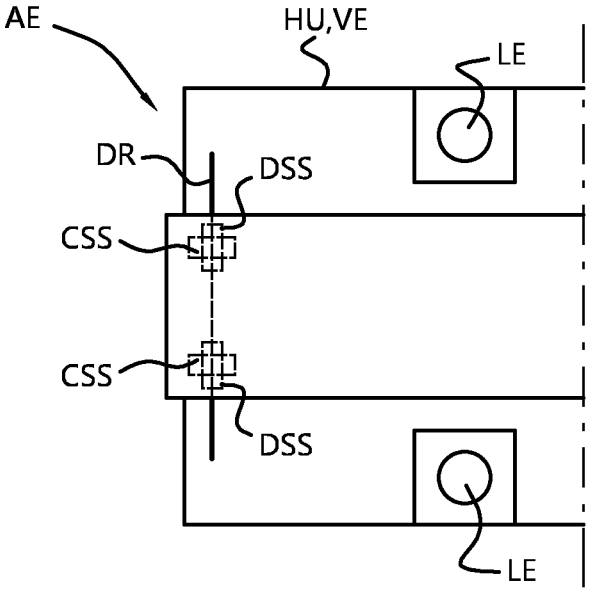
Figure 5:
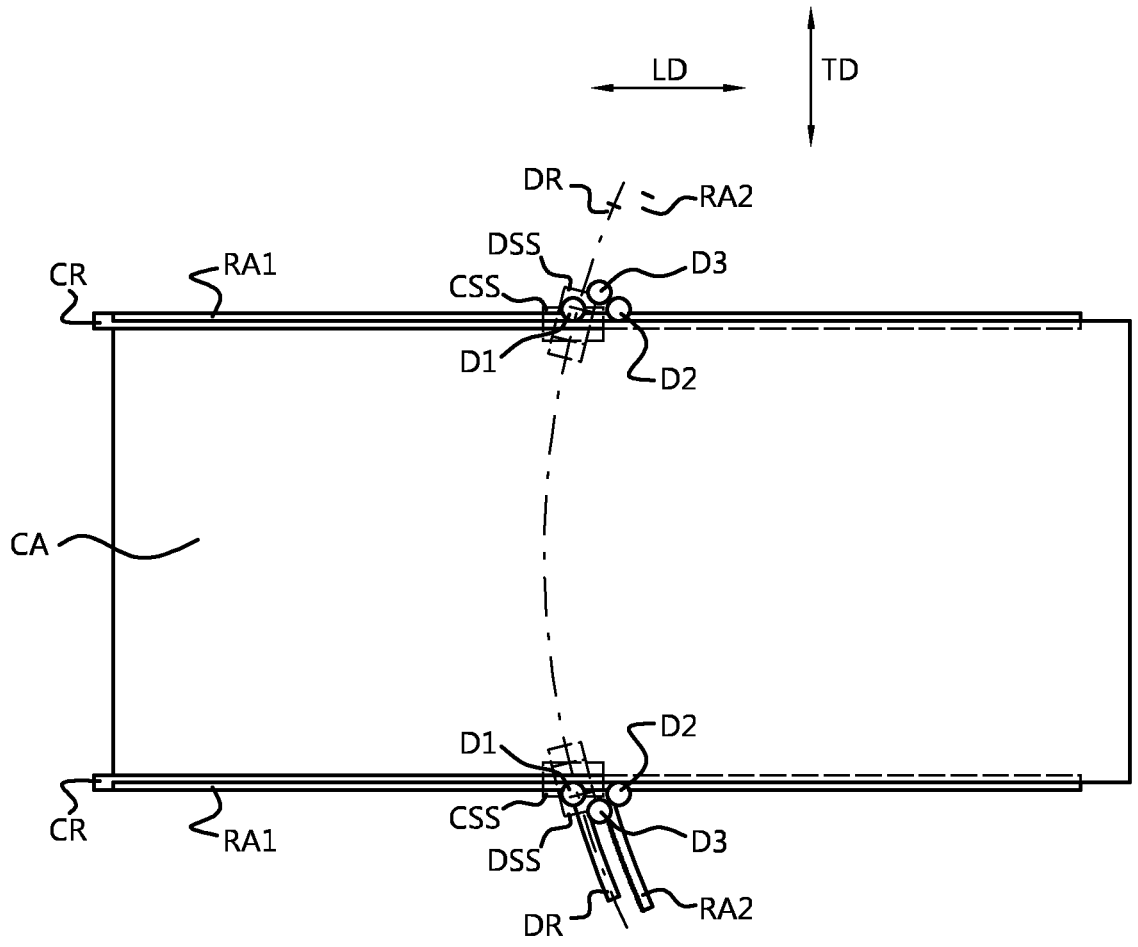

FIG. 5 depicts a sliding assembly for an offshore system according to another embodiment of the invention. FIG. 5 only shows the cantilever CA, the deck DE is in this Figure not explicitly shown. As in FIG. 3B, the offshore system comprises two sliding assemblies, one sliding assembly on each side of the cantilever. However, as in FIG. 3B, the sliding assemblies will share at least one part.

Each sliding assembly comprises a cantilever rail CR arranged on the cantilever CA and extending in a longitudinal direction LD, a cantilever slide shoe engaging with the cantilever rail CR, and a deck slide shoe DSS engaging with a commonly shared deck rail DR arranged on the deck and substantially extending in a transverse direction TD perpendicular to the longitudinal direction LD. The cantilever slide shoe is arranged on top of the deck slide shoe.

The deck rail in this embodiment is arcuate, i.e. part of a circle, wherein the radius of curvature and the corresponding centre point coincide with the swivel axis SA of the cantilever CA having the advantage that rotating the cantilever about the swivel axis using the sliding assemblies will not change the orientation of the deck slide shoe relative to the cantilever slide shoe, so that these components can be integrated or rigidly connected.

In this embodiment, the sliding assemblies also comprise the actuators to move and rotate the cantilever, wherein the actuators comprise a first actuator at each sliding assembly having a rack and pinion configuration for moving the cantilever CA in the longitudinal direction relative to the cantilever slide shoe, wherein a rack RA1 is arranged on the cantilever CA and the pinion including drives D1, D2 thereof are mounted to the cantilever slide shoe.

The actuators also comprise a second actuator at each sliding assembly having a rack and pinion configuration for moving the deck slide shoe DSS in the transverse direction TD relative to the deck, wherein a rack RA2 is arranged on the deck and the pinion including drive D3 thereof is mounted to the deck slide shoe DSS.

Due to the arcuate shape of the deck rail DR, the rack RA2 of the second actuators is also arcuate having a similar radius of curvature. Because the deck rail DR is shared, the rack RA2 is also shared in this embodiment.

It will be appreciated by the skilled person that although specific embodiments and examples have been described with respect to the drawings, the invention is not limited to these specific embodiments and examples and the skilled person may vary or change features while still fall within the intended scope of the claims.

Examples thereof are:

- the exchange of rails and slide shoes where applicable;
- the sliding and swivel assembly may be provided at the operational end while the sliding assembly or sliding assemblies may be provided at the inner end;
- exchanging rails and slide shoes for other types of bearings;
- exchanging actuators for other configurations, including amongst others skidding systems; and
- separating the sliding assemblies and the actuators.

The use and purpose of the cantilever has not been specified, but the operational end of the cantilever may be used to accommodate a drilling tower, a crane, a multipurpose tower or any other equipment. Equipment may also be deliberately positioned at the inner end to form counterweight for equipment at the operational end.

The invention claimed is:

1. An offshore system comprising:

a vessel having a deck;

a cantilever which is mounted on the deck and which is moveable in a longitudinal direction of the cantilever relative to the deck between a retracted position and an extended position, and which is rotatable relative to the deck about a substantially vertical swivel axis; and actuators to move the cantilever in longitudinal direction and to rotate the cantilever about the swivel axis, wherein the swivel axis is provided by a single sliding and swivel assembly arranged at one end of the cantilever, comprising a fixed part mounted to the deck and a sliding part mounted to the cantilever, wherein the sliding part is arranged to slide in longitudinal direction of the cantilever relative to the fixed part when the cantilever moves in the longitudinal direction, and wherein the fixed part and/or the combination of fixed part and sliding part are configured to form the swivel axis allowing the cantilever to rotate relative to the deck, wherein a sliding assembly is arranged at the other end of the cantilever supporting the cantilever and allowing the cantilever to slide in longitudinal direction of the cantilever relative to the deck during movement of the cantilever in longitudinal direction, and to slide in a transverse direction perpendicular to the longitudinal direction relative to the deck during rotation of the cantilever relative to the deck.

2. The offshore system according to claim 1, wherein the fixed part of the sliding and swivel assembly comprises a stationary part and a rotatable part with a bearing in between the stationary part and the rotatable part forming the substantially vertical swivel axis.

3. The offshore system according to claim 2, wherein the sliding part of the sliding and swivel assembly comprises one or more rails engaging with sliding shoes arranged on the rotatable part of the fixed part of the sliding and swivel assembly.

4. The offshore system according to claim 3, wherein cables and/or hoses are provided between the vessel and the cantilever for power and/or fluid transport, which cable and/or hoses extend through the sliding and swivel assembly.

5. The offshore system according to claim 2, wherein cables and/or hoses are provided between the vessel and the cantilever for power and/or fluid transport, which cable and/or hoses extend through the sliding and swivel assembly.

6. The offshore system according to claim 2, wherein the cantilever comprises an operational end which extends beyond the deck, in the extended position of the cantilever and an inner end opposite the operational end.

7. The offshore system according to claim 1, wherein cables and/or hoses are provided between the vessel and the cantilever for power and/or fluid transport, which cable and/or hoses extend through the sliding and swivel assembly.

8. The offshore system according to claim 1, wherein the cantilever comprises an operational end which extends beyond the deck, in the extended position of the cantilever and an inner end opposite the operational end.

9. The offshore system according to claim 8, wherein the sliding and swivel assembly is located at the inner end of the cantilever and the sliding assembly is located at the operational end of the cantilever.

10. The offshore system according to claim 8, wherein equipment is positioned at the inner end of the cantilever for providing counterweight to the equipment positioned at the operational end of the cantilever.

11. The offshore system according to claim 1, wherein the sliding assembly comprises a cantilever rail arranged on the cantilever and extending in the longitudinal direction, a deck rail arranged on the deck and substantially extending in the transverse direction, a deck slide shoe engaging with the deck rail, and a cantilever slide shoe engaging with the cantilever rail and arranged on top of the deck slide shoe.

12. The offshore system according to claim 11, wherein the deck rail has a radius of curvature and corresponding centre point coinciding with the swivel axis.

13. The offshore system according to claim 11, wherein the actuators comprise a first actuator having a rack and pinion configuration for moving the cantilever in the longitudinal direction relative to the cantilever slide shoe, and wherein the rack is arranged on the cantilever and the pinion including drive thereof is mounted to the cantilever slide shoe.

14. The offshore system according to claim 11, wherein the actuators comprise a second actuator having a rack and pinion configuration for moving the deck slide shoe relative to the deck, and wherein the rack is arranged on the deck and the pinion including drive thereof is mounted to the deck slide shoe.

15. The offshore system according to claim 11, wherein the actuators are arranged on the cantilever slide shoe and/or the deck slide shoe.

16. The offshore system according to claim 1, wherein the vessel comprises an elongated hull, with an aft end or stern and a front end or bow, and wherein a longitudinal axis of the cantilever is substantially parallel to a longitudinal axis of the elongated hull so that the cantilever in the extended position extends beyond the aft end or stern of the hull.

17. The offshore system according to claim 16, wherein the jack-up system comprises four legs, two at the aft end or stern of the hull and two further towards the front end or bow of the hull, wherein the cantilever extends or is arranged between the two legs at the aft end of the hull.

18. The offshore system according to claim 1, wherein the vessel comprises a jack-up system with legs to lift the hull of the vessel relative to a bottom of a body of water.

19. A method for performing subsea wellbore related activities, comprising the step of using the offshore system according to claim 1.

20. The offshore system according to claim 1, wherein the swivel axis is provided at a fixed location relative to the deck.

* * * * *